US011426794B2

(12) United States Patent
Nesteroff et al.

(10) Patent No.: US 11,426,794 B2
(45) Date of Patent: Aug. 30, 2022

(54) COMPOSITE STRUCTURES INCLUDING MULTIPLE MATERIALS FORMED USING COLD SPRAYING

(71) Applicants: Rolls-Royce Corporation, Indianapolis, IN (US); Rolls-Royce North American Technologies, Inc., Indianapolis, IN (US)

(72) Inventors: Michael Nesteroff, Indianapolis, IN (US); Matthew R. Gold, Carmel, IN (US)

(73) Assignees: ROLLS-ROYCE CORPORATION, Indianapolis, IN (US); ROLLS-ROYCE NORTH AMERICAN TECHNOLOGIES, INC., Indianapolis, IN (US)

( * ) Notice: Subject to any disclaimer, the term of this patent is extended or adjusted under 35 U.S.C. 154(b) by 91 days.

(21) Appl. No.: 16/594,747

(22) Filed: Oct. 7, 2019

(65) Prior Publication Data

US 2020/0109645 A1 Apr. 9, 2020

Related U.S. Application Data

(60) Provisional application No. 62/742,766, filed on Oct. 8, 2018.

(51) Int. Cl.
*B22F 7/08* (2006.01)
*C23C 24/04* (2006.01)
(Continued)

(52) U.S. Cl.
CPC ..... *B22F 7/08* (2013.01); *B22F 5/009* (2013.01); *C23C 24/04* (2013.01); *F01D 25/14* (2013.01);
(Continued)

(58) Field of Classification Search
CPC ..... C23C 24/04; B22F 2005/005; B22F 2005/103; F05D 2230/30
See application file for complete search history.

(56) References Cited

U.S. PATENT DOCUMENTS 6,602,545 B1 8/2003 Shaikh et al.
2006/0093736 A1* 5/2006 Raybould ..... C23C 28/028 427/180
(Continued)

FOREIGN PATENT DOCUMENTS

CN 106609369 A 5/2017

OTHER PUBLICATIONS

Vo, P., et al. "Mechanical and microstructural characterization of cold-sprayed Ti-6Al-4V after heat treatment." Journal of thermal spray technology 22.6 (2013): 954-964 (Year: 2013).*
(Continued)

*Primary Examiner* — Anthony J Zimmer
*Assistant Examiner* — Sean P. O'Keefe
(74) *Attorney, Agent, or Firm* — Shumaker & Sieffert, P.A.

(57) ABSTRACT

A composite component may include a substrate including a first material and defining a surface; and at least one feature attached to the surface of the substrate. The at least one feature may include a second, different material attached to the surface using cold spraying. Cold spraying may include accelerating particles of the second material toward the surface without melting the particles.

8 Claims, 5 Drawing Sheets

(51) Int. Cl.
*B22F 5/00* (2006.01)
*F01D 25/14* (2006.01)

(52) U.S. Cl.
CPC ..... *F05D 2230/30* (2013.01); *F05D 2240/14* (2013.01)

(56) References Cited

U.S. PATENT DOCUMENTS

| | | | | |
|---|---|---|---|---|
| 2006/0134320 | A1 | 6/2006 | DeBiccari et al. | |
| 2015/0147479 | A1* | 5/2015 | Bunker | C23C 24/04 427/448 |
| 2015/0290875 | A1 | 10/2015 | Mark et al. | |
| 2016/0023275 | A1 | 1/2016 | Propheter-Hinckley et al. | |
| 2018/0104893 | A1 | 4/2018 | Bougelet et al. | |
| 2018/0178332 | A1* | 6/2018 | Roberge | B33Y 10/00 |
| 2018/0223870 | A1* | 8/2018 | Parthasarathy | B23P 6/007 |
| 2019/0234697 | A1* | 8/2019 | Chipko | F28D 7/16 |

OTHER PUBLICATIONS

Damping Characteristics of Metal Matrix Composites, Final Report for the Office of Naval Research Department of the Navy, May 1989, 194 pgs.
Cold Spray: A guide to best practice, Arbegast Materials Processing and Joining Lab, 2012, 31 pgs. Applicant points out, in accordance with MPEP 609.04(a), that the year of publication, 2012, is sufficiently earlier than the effective U.S. filing date, 2018, so that the particular month of publication is not in issue.
Gabel et al., "Solid-State Spray Forming of Aluminum Near-Net Shapes", Aug. 1997, 3 pgs.
Kinetic Metallization: Metal Matrix Composites, Retrieved from http://www.inovati.com/information/Applications/mmcstiff.php on Sep. 26, 2018, 3 pgs.
Titomic Kenetic Fusion, https://www.titomic.com/titomic-kinetic-fusion.html on Sep. 26, 2018, 3 pgs.
Villafuerte, Using Cold Spray to Add Features to Components, Jun. 2015, 46 pgs.
Vo et al., Build strategies for additive manufacturing by cold spray, CSAT Jun. 14, 2017, 22 pgs.

* cited by examiner

COMPOSITE STRUCTURES INCLUDING MULTIPLE MATERIALS FORMED USING COLD SPRAYING

This application claims the benefit of U.S. Provisional Application Ser. No. 62/742,766, entitled "COMPOSITE STRUCTURES INCLUDING MULTIPLE MATERIALS FORMED USING COLD SPRAYING," and filed on Oct. 8, 2018, the entire content of which is incorporated herein by reference.

TECHNICAL FIELD

The disclosure relates to techniques for forming composite structures including multiple materials using cold spray.

BACKGROUND

Composite components may be used in mechanical systems, such as gas turbine engines. A composite component may include a bulk structure, such as a casing, and functional features, such as flanges, bosses, or the like, attached to the bulk structure.

SUMMARY

In some examples, the disclosure describes a method that includes forming a substrate from a first material, the substrate defining a surface. The method also includes cold spraying a second material that includes a metal or alloy on to at least a portion of the surface of the substrate to form at least one feature. The cold spraying includes accelerating particles of the second material toward the surface without melting the particles.

In some examples, the disclosure describes a composite material that includes a substrate comprising a first material, the substrate defining a surface. The composite material also includes at least one feature attached to the surface of the substrate. The at least one feature includes a second, different material attached to the surface using cold spraying, which includes accelerating particles of the second material toward the surface without melting the particles. The second, different material includes a metal or alloy.

In some examples, the disclosure describes a component of a gas turbine engine, that includes a casing comprising a first material, the casing defining a surface. The component also includes at least one feature attached to the surface of the casing. The at least one feature includes a second, different material attached to the surface using cold spraying, which includes accelerating particles of the second material toward the surface without melting the particles. The second, different material includes a metal or alloy. The at least one feature defines at least a portion of a cooling system of the gas turbine engine.

The details of one or more examples are set forth in the accompanying drawings and the description below. Other features, objects, and advantages will be apparent from the description and drawings, and from the claims.

DETAILED DESCRIPTION

Figure 1:
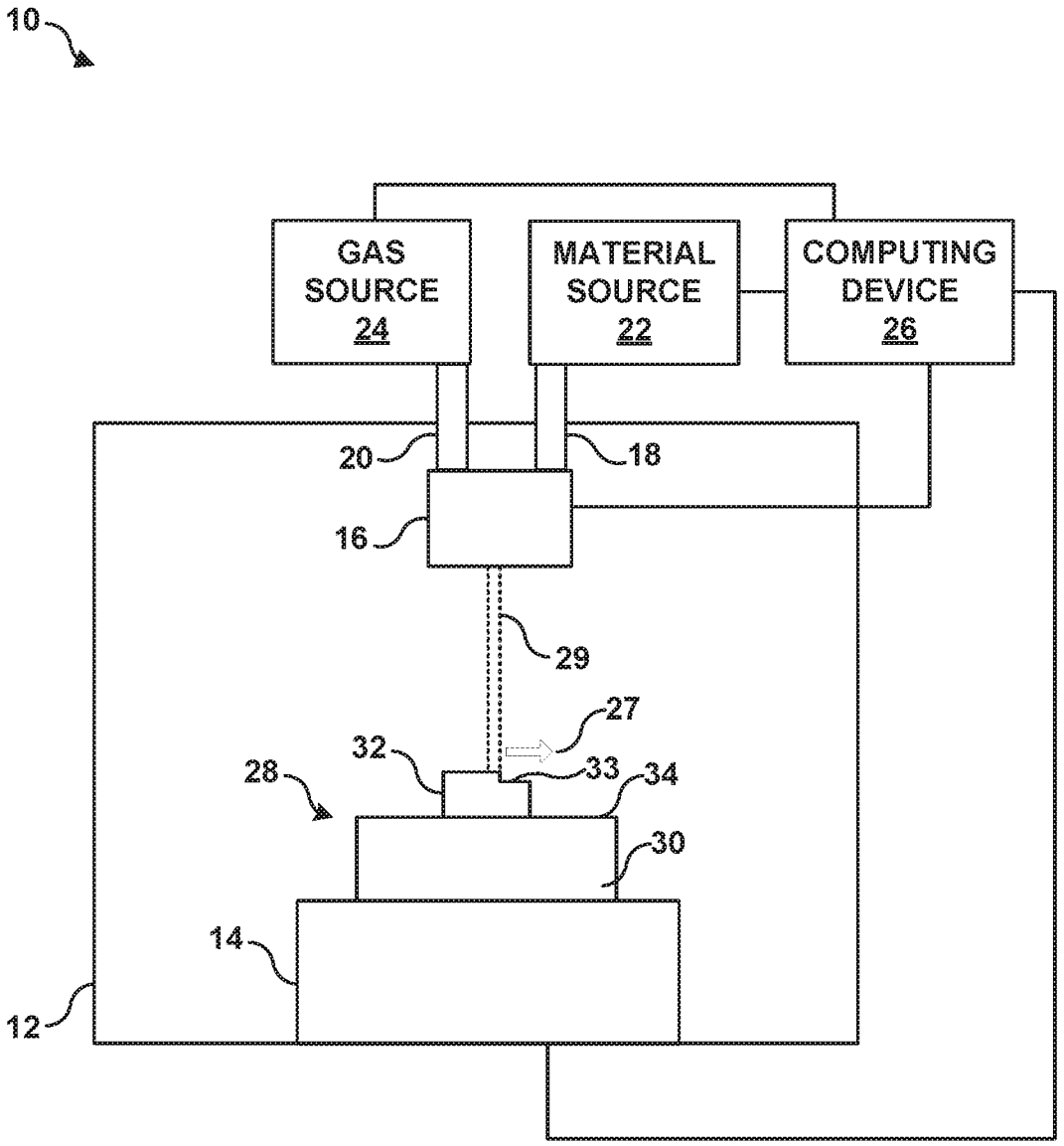
FIG. 1 is a conceptual and schematic diagram illustrating an example system for forming a composite component using cold spraying.

The disclosure describes composite components and techniques for forming composite components including a substrate that includes a first material and at least one feature that includes a second material. The substrate may include, for example, a bulk structure, such as a casing, a housing, a baffle, a flange, a wall portion, or other component of a gas turbine engine. The at least one feature is formed on a surface of the substrate by cold spraying particles of the second material on to the surface. The second material may be a metal or alloy. In some examples, the second material is different than the first material. In some examples, the second material is the same as the first material. For example, cold spraying the second material and subsequently machining the second material to a selected shape may reduce manufacturing cost of the component, increase manufacturing efficiency, and/or improve feature tolerances compared to other technique, such as casing. Additionally or alternatively, the second material may be selected to have mechanical properties, chemical properties, or both that improve the function of the at least one feature and/or the composite component. Additionally or alternatively, the second material may be selected to reduce manufacturing cost of the component, increase manufacturing efficiency, and/or reduce the weight of the component.

Aircraft components, such as gas turbine engine components, may include materials having relatively higher density and relatively higher melting points to withstand high mechanical stresses and high temperatures environments. For example, nickel based alloys, high alloyed steels, or titanium alloys may be relatively denser and have a relatively higher melting temperature compared to aluminum alloys, the mechanical properties of which may degrade when subjected to typical turbine compressor discharge temperatures. Relatively higher density and/or relatively higher melting point materials may be more expensive to manufacture, weigh more than relatively less dense and/or relatively lower melting point materials, or both. For example, aluminum may be less costly to manufacture and less dense relative to nickel based alloy, high alloyed steel, or titanium alloy.

In some examples, to reduce manufacturing costs, reduce weight, or both of aircraft components, composite components including two or more materials may be used. Some composite components may be difficult to manufacture or require relatively longer manufacturing times compared to components formed form a single material. To increase manufacturing efficiency and provide desirable mechanical properties and/or chemical properties, the disclosure describes forming composite components using cold spraying to form selected features on bulk materials.

In some examples, the at least one feature may include at least one boss of a gas turbine engine casing. In operation of the gas turbine engine, the at least one boss may experience lower mechanical stress and/or lower temperatures relative to other portions of the casing. Because the at least one boss is exposed to relatively lower mechanical stress and/or relatively lower temperatures, the at least one boss may be formed using a relatively lower density and/or relatively lower melting point material (e.g., the second material) compared to other portions of the casing (e.g., the first material). By forming the at least one boss from a relatively lower density material, the weight of the composite component may be less than if the bosses were formed from the first material. Additionally or alternatively, by forming the at least one boss from a relatively lower melting point material, the cost of manufacturing the component may be less than if the bosses were formed from the first material.

In some examples, the at least one feature may include at least one baffle of a gas turbine engine casing. In operation of the gas turbine engine, the at least one baffle may experience higher mechanical stress and/or higher temperatures relative to other portions of the casing. Because the at least one baffle is exposed to relatively higher mechanical stress and/or relatively higher temperatures, the at least one baffle may be formed using a relatively higher density and/or relatively higher melting point material (e.g., the second material) compared to other portions of the casing (e.g., the first material). By forming the at least one baffle from a relatively higher density material (and other portions of the casing from a relatively lower density material), the weight of the composite component may be less than if the bosses were formed from the second material. Additionally or alternatively, by forming the at least one baffle from a relatively higher melting point material (and other portions of the casing from a relatively lower melting point material), the costs of manufacturing the component may be less than if the entire casing were formed from the second material. In some examples, a relatively higher density and/or relatively higher melting point material may shield from heat and/or exposure to hot gas stream a bulk material that has a relatively lower density and/or relatively lower melting point.

In some examples, the at least one feature may include at least one flange on a gas turbine engine casing formed from a sheet metal. By forming the flange using cold spraying, and optionally machining to remove excess material, the cost of manufacturing the casing may be reduced and/or manufacturing efficiency may be increased, for example, compared to a process requiring forging equipment to separately form a forged flange and welding the forged flange to the casing.

In some examples, the at least one feature may include a wall defining one or more internal channels, such as, for example, a portion of a fluid transfer system or cooling system. Forming the at least one feature that includes a wall defining one or more internal channels may include positioning at least one insert on a surface of a substrate and cold spraying the wall to substantially encapsulate (e.g., partially surround or completely surround) the at least one insert. In some examples, the at least one insert may include a plurality of cooling circuitry tubes or a sacrificial material. In examples in which the at least one insert includes a sacrificial material, the sacrificial material may be removed (e.g., after the at least one feature is formed by cold spraying) by, for example, pyrolyzing the sacrificial material or chemically etching the sacrificial material.

FIG. 1 is a conceptual and schematic diagram illustrating an example system 10 for forming a composite component 28 using cold spraying. System 10 may include an enclosure 12, which encloses a stage 14, a cold spray gun 16, a material feed 18, and a gas feed 20. System 10 also may include a material source 22, which is operatively coupled to cold spray gun 16 via material feed 18, and a gas source 24, which is fluidly connected to cold spray gun 16 via gas feed 20. System 10 further may include a computing device 26, which is communicatively connected to stage 14, cold spray gun 16, material feed 18, gas feed 20, material source 22, and gas source 24.

A composite component 28 also is positioned within enclosure 12. In some examples, composite component 28 may include a component of a gas turbine engine. Composite component 28 includes a plurality of parts (e.g., at least two) formed from different materials, including a substrate 30 and at least one feature 32. In some examples, substrate 30 may include a bulk material, such as a forged metal, a cast metal, a plate metal, a bar metal, or a sheet metal. In some examples, the bulk material (e.g., "first material") of substrate 30 may be substantially homogeneous (e.g., homogeneous or nearly homogeneous to the extent possible by common metallurgy techniques). The bulk material may include, but is not limited to, a Ni-based alloy, a Co-based alloy, a Ti-based alloys, an Al-alloy, a Cu-alloy, or a Fe-based alloy. Regardless of the type of bulk material, substrate 30 includes a surface 34. System 10 is configured to form at least one feature 32 on a surface 34. At least one feature 32 includes a second material. In some examples, the second material is different than the first material. In other examples, the second material is the same as the first material. The second material may include a metal or alloy. In some examples, second material of at least one feature 32 may be substantially homogeneous (e.g., homogeneous or nearly homogeneous to the extent possible by common metallurgy techniques). In some examples, the second material may include, for example, a Ni-based alloy, a Co-based alloy, a Ti-based alloy, an Al-alloy, a Cu-alloy, or a Fe-based alloy.

Enclosure 12 may substantially enclose (e.g., enclose or nearly enclose) stage 14, cold spray gun 16, material feed 18, gas feed 20, and component 28. Enclosure 12 may maintain a desired atmosphere (e.g., an atmosphere that is substantially inert to the materials from which substrate 30 and at least one feature 32 are formed) around substrate 30 and at least one feature 32 during the cold spray technique. In some examples, system 10 may not include enclosure 12 and/or stage 14. For example, system 10 may include a handheld device.

In some examples, stage 14 may be configured to selectively position and restrain composite component 28 in place relative to stage 14 during formation of at least one feature 32. In some examples, stage 14 is movable relative to cold spray gun 16. For example, stage 14 may be translatable and/or rotatable along at least one axis to position component 28 relative to cold spray gun 16. Similarly, in some examples, cold spray gun 16 may be movable relative to stage 14 to position cold spray gun 16 relative to composite component 28.

Material source 22 may include, for example, a hopper or other container containing a plurality of particles of the second material. The particles may include any suitable particle size. For example, the size range of the particles of the second material may be between about 1 micrometer (μm) and about 60 μm, such as between about 5 μm and about 20 μm. In some examples, the particular size distribution may include a D50 of between about 25 μm and about 40 μm, a D10 of between about 5 μm and about 25 μm, and a D90 of between about 45 μm and about 60 μm. The size range of the particles of the second material may be selected to achieve a selected impact velocity, e.g., a velocity of the particles when impacting surface 34. In some examples, material source 22 may include an pneumatic hopper operatively coupled to gas source 24, such that gas source 24 enables material source 22 to feed the plurality of particles to cold spray gun 16. Computing device 26 may be communicatively coupled to material source 22 and/or material feed 18 to control a rate of material flow from material source 22 to cold spray gun 16 via material feed 18. For example, computing device 26 may control a valve or a feeder system of material feed 18.

Gas source 24 may include, for example, a source of helium, nitrogen, argon, other substantially inert gas, or mixtures thereof, which may function as carrier of the plurality of particles. Gas source 24 is fluidically coupled to gas feed 20, which may control a flow rate and/or pressure of gas delivered to cold spray gun 16. In some examples, gas feed 20 may include a heater to heat the gas. The pressure of the gas in gas source 24 (or gas feed 20) may be sufficient to achieve supersonic velocities of the gas and/or plurality of particles at the outlet of a nozzle. In some examples, the pressure of the gas may be between about 0.1 megapascals (MPa) and about 6 MPa, such as between about 3.5 MPa and about 5.5 MPa. In some examples, the supersonic velocities may be between about 500 meters per second (m/s) to about 1000 m/s.

Cold spray gun 16 may be configured to entrain the plurality of particles of the second material from material source 22 in the flow of gas from gas source 24 through a nozzle. The nozzle may accelerate the gas and plurality of particles to high velocities. The resultant high velocity particle stream 29 may be directed toward surface 34 of substrate 30. Without limiting the description to a specific theory, the high velocity of the plurality of particles may be sufficient to cause plastic deformation of the particles upon impact with surface 34 of substrate 30. This process is repeated as a plurality of particles attach to surface 34 and/or other attached particles defining a build surface 33.

System 10 may be configured to control relative movement 27 of high velocity particle stream 29 with respect to surface 34 of substrate 30 and/or build surface 33. For example, directing high velocity particle stream 29 toward substrate 30 may result in deposition of the plurality of particles on surface 34 of substrate 30 and/or build surface 33. As illustrated in FIG. 1, the plurality of particles may accumulate to form at least one feature 32. For example, the high velocity particle stream 29 may be moved over surface 34 and/or build surface 33 until a sufficient amount of the second material has accumulated to define, at least roughly, at least one feature 32. For example, excess second material may be deposited to form a structure with larger dimensions than at least one feature 32, then excess second material may be machined away to define at least one feature 32. Although not illustrated in FIG. 1, system 10 may also include a milling device or machining device configured to remove deposited material to define a final shape of at least one feature 32. In some examples, cold spraying the second material, and subsequently machining the second material to define the final shape may reduce manufacturing cost, improve manufacturing efficiency, and/or improve final shape dimension tolerances compared to other manufacturing techniques.

Computing device 26 may include, for example, a desktop computer, a laptop computer, a tablet, a workstation, a server, a mainframe, a cloud computing system, or the like. Computing device 26 may include or may be one or more processors or processing circuitry, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some examples, the functionality of computing device 26 may be provided within dedicated hardware and/or software modules.

Computing device 26 is configured to control operation of system 10, including, for example, stage 14, cold spray gun 16, material feed 18, gas feed 20, material source 22, and/or gas source 24. Computing device 26 may be communicatively coupled to at least one of stage 14, cold spray gun 16, material feed 18, gas feed 20, material source 22, and/or gas source 24 using respective communication connections. Such connections may be wireless and/or wired connections.

Computing device 26 may be configured to control operation of stage 14 and/or cold spray gun 16 to position composite component 28 relative to cold spray gun 16. For example, as described above, computing device 26 may control stage 14 and/or cold spray gun 16 to translate and/or rotate along at least one axis to position composite component 28 relative to cold spray gun 16.

Computing device 26 may control at least one of the feed rate of the plurality of particles from material source 22, pressure gas source 24, flow rate of the gas through gas feed 24, the relative movement 27 of high velocity particle stream 29 relative to composite component 28, a distance between cold spray gun 16 and build surface 33, the angle of high velocity particle stream 29 relative to build surface 33, or tool path. The tool path may include the width of the overlap between adjacent passes of the high velocity particle stream 29 and the velocity of cold spray gun 16 relative to build surface 33. Computing device 26 may control at least one of these parameters to control the amount of material added to composite component 28 at a given time and location and/or to control metallurgical properties of the added material. In some examples, cold spray gun 16 may be scanned (e.g., translated) relative to at least one feature 32, and the second material may be accumulate in a general shape corresponding to the scanned path.

Figure 2:
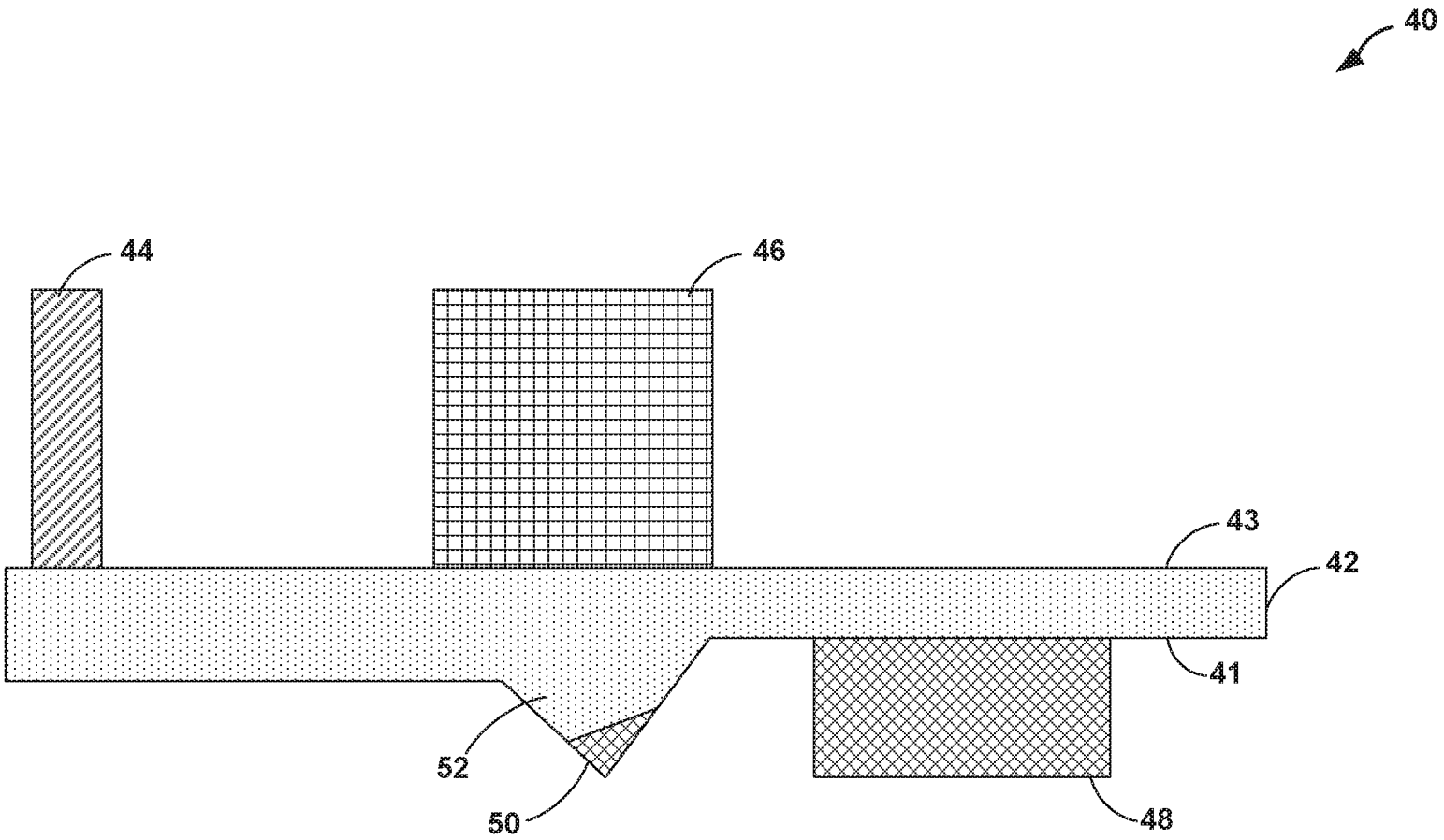
FIG. 2 is a conceptual cross-sectional view of an example composite component that includes a substrate including a first material and a flange, a boss, a baffle, and a wall portion formed by cold spraying a second material on to the substrate.

In accordance with examples of this disclosure, system 10 may be used to form a composite component 28 including at least one feature 32 attached to surface 34 of substrate 30. In some examples, the second material of at least one feature 32 may be different than a first material of substrate 30 and selected to improve physical attributes of composite component 28 compared to a composite component 28 that is formed from a single material. FIG. 2 is a conceptual cross-sectional view of a portion of an example composite component 40 that includes a substrate 42 including a first material and a plurality of features. Substrate 42 may include cylindrical structure having an interior surface 41 and an exterior surface 43. The plurality of features include a flange 44, a boss 46, a baffle 48, and a wall portion 50, each of which may be formed by cold spraying a second material on to substrate 42, as discussed above.

In some examples, flange 44 may be attached to exterior surface 43 of substrate 42. In some examples, flange 44 may be attached to interior surface 41. In some examples, composite component 40 may include a plurality of flanges on terminal ends or other surfaces of composite component 40. In some examples, flange 44 may include a core of the first material, the core being coated in the second material. Flange 44 may be configured to mechanically couple composite component 40 to other components, such as other components of a gas turbine engine. In some examples, forming flange 44 may cold spraying the second material onto substrate 42 and, optionally, machining the second material to define a final shape of flange 44 may enable flange 44 to be formed within more stringent final shape tolerances compared to other manufacturing techniques.

In some examples in which composite component 40 includes a component of a gas turbine engine, during operation of the gas turbine engine, flange 44 may experience relatively higher mechanical stress and/or relatively higher temperatures than adjacent portions of substrate 44. In examples in which flange 44 experiences relatively higher mechanical stress, flange 44 may include a second material having a relatively higher density compared to a first material of adjacent portions of substrate 42 (e.g., compared to the first material from which other portions of substrate 42 are formed). In some examples in which flange 44 experiences relatively higher temperatures, flange 44 may include a second material having a relatively higher melting point compared to adjacent portions of substrate 42 (e.g., compared to the first material from which other portions of substrate 42 are formed). In this way, composite component 40 may include flange 44 formed from a relatively denser and/or relatively higher melting point second material selected for desired mechanical properties and/or chemical properties, without manufacturing substrate 40 from the second material, which may be more expensive and/or time intensive.

In some examples in which composite component 40 includes a component of a gas turbine engine, during operation of the gas turbine engine, flange 44 may experience relatively lower mechanical stress and/or relatively lower temperatures than adjacent portions of substrate 42. In examples in which flange 44 experiences relatively lower mechanical stress, flange 44 may include a second material having a relatively lower density compared to a first material of adjacent portions of substrate 42 (e.g., compared to the first material from which other portions of substrate 42 are formed). In some examples in which flange 44 experiences relatively lower temperatures, flange 44 may include a second material having a relatively lower melting point compared to adjacent portions of substrate 42 (e.g., compared to the first material from which other portions of substrate 42 are formed). In this way, composite component 40 may include flange 44 formed from a relatively less dense and/or relatively lower melting point second material selected for desired mechanical properties and/or chemical properties, without manufacturing flange 44 from the first material, which may be more expensive and/or time intensive.

In some examples, substrate 42 may include a casing formed from a sheet metal. By forming flange 44 using cold spraying on substrate 42 that includes a sheet metal casing, and optionally machining to remove excess material, the cost of manufacturing composite component 40 may be reduced and/or manufacturing efficiency may be increased compared to a process requiring forging equipment to separately form a forged flange and welding the forged flange to the substrate.

In some examples, boss 46 may be attached to exterior surface 43 of substrate 42. In other examples, boss 46 may be attached to interior surface 41. In some examples, composite component 40 may include a plurality of bosses on other portions of composite component 40. In examples in which composite component 40 is a component of a gas turbine engine, during operation of the gas turbine engine, boss 46 may experience lower mechanical stress and/or lower temperatures relative to other portions of substrate 42. Because boss 46 is exposed to relatively lower mechanical stress and/or relatively lower temperatures, boss 46 may include relatively lower tensile properties, relatively lower density, and/or relatively lower melting point second material compared to substrate 40 that includes a first material. By forming boss 46 from a relatively lower density material, the weight of composite component 40 may be less than if boss 46 included the first material. Additionally or alternatively, by forming boss 46 from a relatively lower melting point material, the cost of manufacturing the component may be less than if boss 46 included the first material.

In some examples, baffle 48 and/or wall portion 50 may experience higher mechanical stress and/or higher temperatures relative to adjacent portions of substrate 42. For example, baffle 48 and/or wall portion 50 may include features defining or exposed to a flow path of hot gases in a gas turbine engine. Similar to the above discussion, because baffle 48 and/or wall portion 50 may be exposed to relatively higher mechanical stress and/or relatively higher temperatures, baffle 48 and/or wall portion 50 may include relatively higher tensile properties, relatively higher density, and/or relatively higher melting point second material compared to adjacent portions of substrate 42 including a first material. By forming baffle 48 and/or wall portion 50 from a relatively higher density material and other portions of composite component 40, such as substrate 42, from a relatively lower density material, the weight of the composite component 40 may be less than if substrate 42 included the second material. Additionally or alternatively, by forming baffle 48 and/or wall portion 50 from a relatively higher melting point material and other portions of composite component 40, such as substrate 42, from a relatively lower melting point material, the costs of manufacturing composite component 40 may be less than if substrate 40 included the second material.

In some examples, a relatively higher density and/or relatively higher melting point second material may act as a heat shield for substrate 40, which may have a relatively lower density and/or relatively lower melting point. For example, wall portion 50 may shield substrate portion 52 from heat that may otherwise damage substrate portion 52.

Figure 3A:
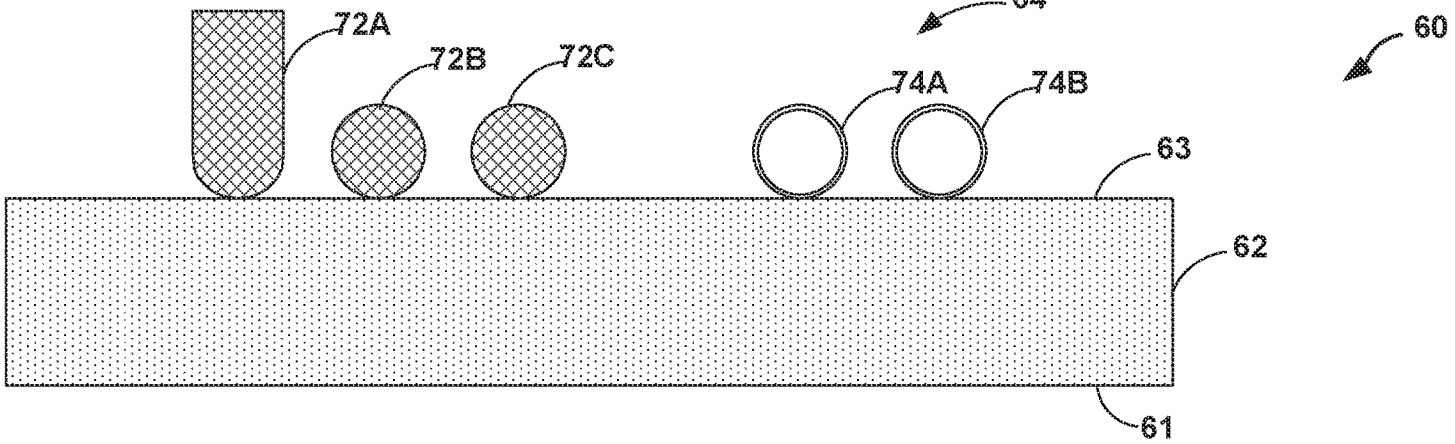
FIGS. 3A and 3B are cross-sectional views of an example composite component including a substrate, a plurality of inserts, and a feature substantially encapsulating the plurality of inserts.
Figure 3B:
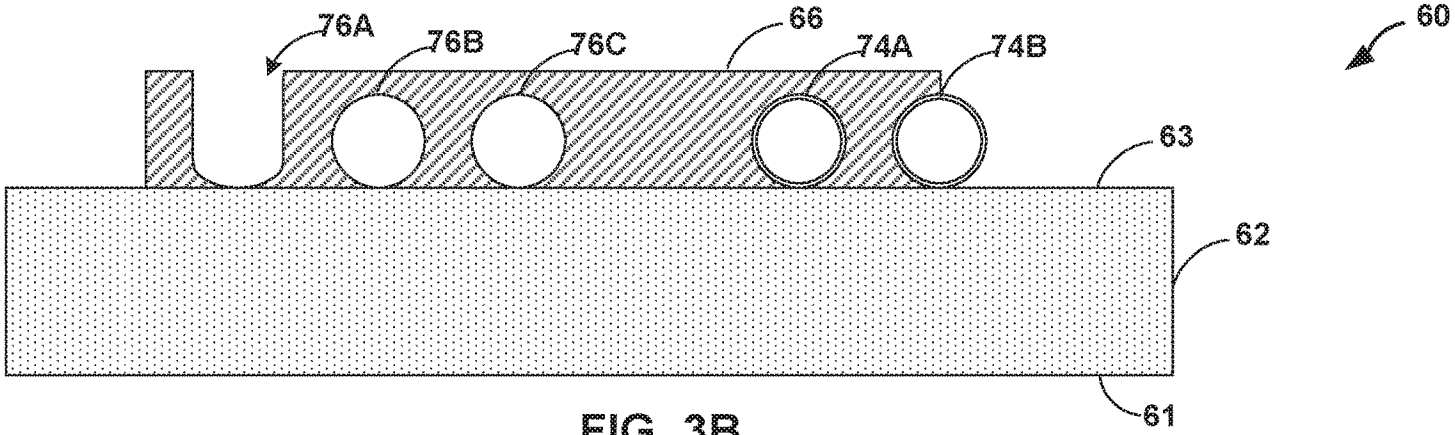

In some examples, the systems and techniques described herein may use inserts to form composite components that include a wall defining internal channels, threaded holes, through-holes, or other complex geometries embedded in or on the surface of a feature. FIGS. 3A and 3B are cross-sectional views of an example composite component 60 including a substrate 62, inserts 64, and a feature 66 substantially encapsulating plurality of inserts 64. Substrate 62 may be the same as or substantially similar to any of substrates 30 and 42 discussed above in reference to FIGS. 1 and 2. For example, substrate 62 defines interior surface 61 and exterior surface 63. Similarly, feature 66 may be the same as or substantially similar to features 32, 44, 46, 48, and 50.

Composite component 60 may include inserts 64 disposed on exterior surface 63 substrate 62. Inserts 64 may be configured to form a wall defining internal channels, threaded holes, through-holes, or other complex geometries embedded in or on a surface of feature 66. For example, as illustrated in FIG. 3B, feature 66 may be cold sprayed around inserts 64 to substantially encapsulate inserts 64. In some examples, inserts 64 may include a plurality of cooling tubes, such as, for example, cooling tubes 74A and 74B (collectively, cooling tubes 74). Cooling tubes 74 may define a portion of a cooling circuit. For example, cooling tube 74A may be fluidly coupled to cooling tube 74B.

Cooling tubes 74 may include any suitable material or shape configured to withstand the pressure and/or abrasion from cold spraying the second material of feature 66 over cooling tubes 74. In some examples, cooling tube 74 may include a Ni-based alloy, a Co-based alloy, a Ti-based alloy, an Al-alloy, a Cu-alloy, or a Fe-based alloy cooling tubes. The material of cooling tube 74 may be selected to provide selected material properties, such as, for example, modulus, ultimate tensile strength, coating adhesion strength, and/or thermal conductivity. In some examples, a portion of cooling tubes 74 may protrude from feature 66 to enable the cooling tubes to fluidly couple to a cooling system that circulates a coolant through cooling tubes 74.

In some examples, as illustrated in FIG. 3A, inserts 64 may include a sacrificial material, such as sacrificial inserts 72A, 72B, and 72C (collectively, sacrificial inserts 72). Sacrificial inserts 72 may be configured to be removed after feature 66 is cold sprayed over inserts 64. In some examples, sacrificial inserts 72 may be removed by mechanically pulling or twisting sacrificial material. For example, sacrificial insert 72A may include a threaded rod or screw that may be backed out. In some examples, sacrificial inserts 72 may be removed by heating composite component 60 to pyrolyze the sacrificial material. In some examples, sacrificial inserts 72 may be removed by treating composite component 60 to with an etchant to chemically etch the sacrificial material. Sacrificial inserts 72 may include any suitable material or shape configured to withstand the pressure and/or abrasion from cold spraying the second material of feature 66 over sacrificial inserts 72. In some examples, sacrificial inserts 72 may include any suitable sacrificial material, including, but not limited to, low melting temperature alloys relative to the material of cooling tubes 74, materials more easily digested by acid relative to the material of cooling tubes 74, Al-alloys, plastics, rigid plastics, or 3D printable plastics.

In some examples, sacrificial inserts 72 may be used to form a wall defining internal channels in feature 66. For example, each of sacrificial inserts 72A, 72B, and 72C may be physically coupled, such that after removing sacrificial inserts 72A, 72B, and 72C, as illustrated in FIG. 3B, internal channels 76A, 76B, and 76C (collectively, internal channels 76) may be fluidly coupled. In this way, sacrificial inserts 72 may be used to form a portion of a fluid transfer system or cooling system, such as internal channels 76, in feature 66.

Figure 4:
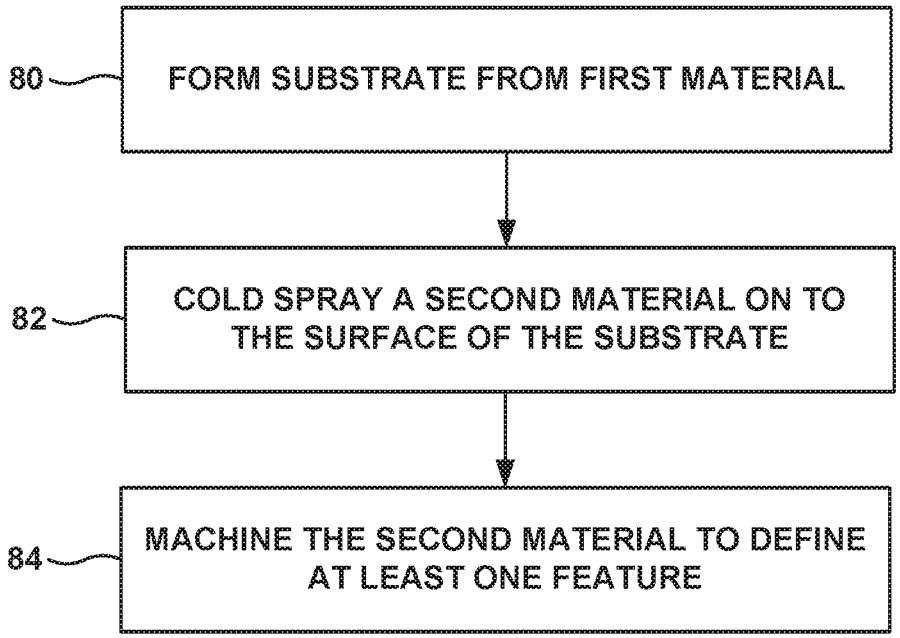
FIG. 4 is a flow diagram illustrating an example technique for cold spraying a feature on to a surface of a substrate to form a composite component.

The composite components described herein may be formed using any suitable technique. FIG. 4 is a flow diagram illustrating an example technique for cold spraying at least one feature 32 on to surface 34 of substrate 30 to form composite component 28. The technique of FIG. 4 will be described with concurrent reference to system 10 of FIG. 1 and composite component 40 of FIG. 2. In other examples, other systems may be used to perform the technique of FIG. 4, the technique of FIG. 4 may be used to form other composite components, or both.

The technique illustrated in FIG. 4 includes forming substrate 30 from a first material (80). For example, forming substrate 30 may include forging, casting, or other metallurgy techniques to define the shape of substrate 30. The first material may include the examples discussed above. The substrate may be formed to define an interior surface and an exterior surface, e.g., surface 34. In some examples, the technique may include surface preparation, such as, for example, abrading surface 34 and/or coating surface 34 with a coating configured to improve bonding of the second material or inserts 64 or to improve mechanical properties or chemical properties of composite component 28, such as one or more thermal barrier coatings or environmental barrier coatings.

The technique illustrated in FIG. 4 also includes cold spraying, using system 10, a second material on to at least a portion of surface 34 of substrate 30 to form at least one feature 32 (82). As discussed above in reference to FIG. 1, cold spraying includes using a cold spray gun 16 and gas source 24 to accelerating particles of the second material from a material source 22 toward surface 34 of substrate 30 without melting the particles. The particles of the second material may contact surface 34 at velocities sufficient to cause plastic deformation of the particles and result in attachment or bonding of the particles to surface 34 and/or other attached particles defining build surface 33.

In some examples, the technique illustrated in FIG. 4 may optionally include, after cold spraying at least one feature 32, machining the second material to define at least one feature 32 (84). For example, forming feature 66 may include cold spraying excess second material on to surface 34, then machining away the excess material. Machining away the excess material may enable system 10 to form at least one feature 32 including more complex geometries, with increased precision (e.g., within predetermined tolerances), or both compared to a technique without machining.

In some examples, the first material of substrate 30 may include a relatively higher density and/or relatively higher melting point temperature metal alloy and the second material of at least one feature 32 material may include a relatively lower density and/or relatively lower melting point temperature metal alloy. By forming at least one feature 32 from a relatively lower density and/or relatively lower melting point temperature metal alloy, may include benefits over forming features 32 from the first material. For example, the manufacturing costs may be reduce by using a relatively less expensive second material and/or reducing need for forging equipment or more complex forging equipment to form features 32 on substrate 30 by forging and, in some examples, welding. As another example, the manufacturing efficiency may be increase by eliminating additional forging and/or welding steps to form features 32.

In some examples, the first material of substrate 30 may include a relatively lower density metal alloy and/or a relatively lower melting point temperature metal alloy and the second material of at least one feature 32 may include a relatively higher density and/or higher melting point temperature metal alloy. By forming at least one feature 32 from a relatively higher density and/or relatively higher melting point temperature metal alloy, may include benefits over forming substrate 30 from the second material. For example, the manufacturing costs may be reduce by using a relatively less expensive first material to form substrate 30 and/or reducing need for forging equipment or more complex forging equipment to form features 32 on substrate 30 by forging and, in some examples, welding. As another example, the manufacturing efficiency may be increase by eliminating additional forging and/or welding steps to form features 32. As another example, at least one feature 32 may have selected mechanical properties, for example, to withstand higher mechanical stress at or near at least one feature 32 relative to adjacent portions of substrate 30, chemical properties, for example, to withstand higher temperatures or propensity to chemical attack at or near at least one feature 32 relative to adjacent portions of substrate 30.

In some examples, substrate 30 may include a sheet metal and at least one feature 32 may include a flange or three dimensional feature on the sheet metal. By forming at least one feature 32 on the sheet metal using cold spraying, components including relatively more complex geometries may be formed using sheet metal substrates.

Figure 5:
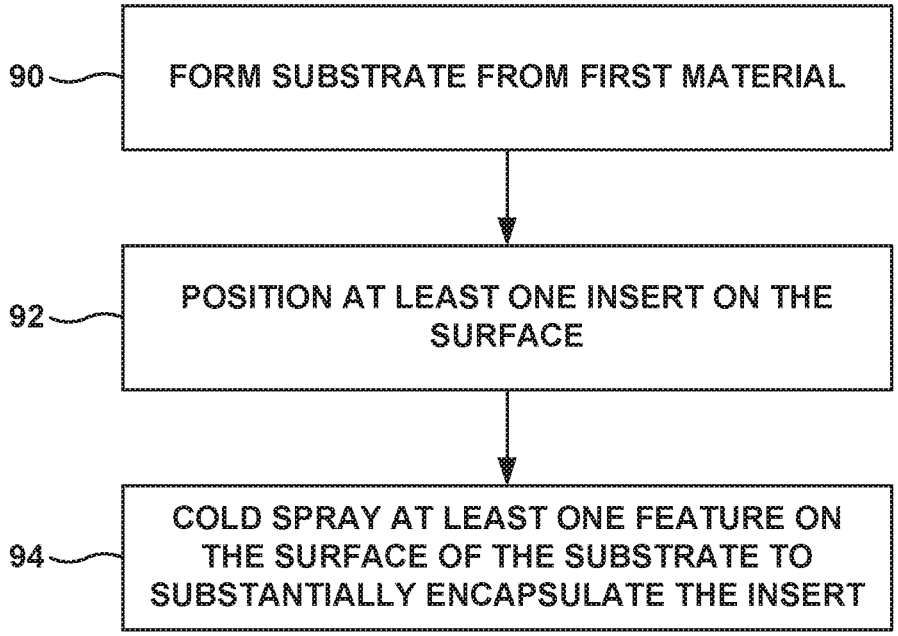
FIG. 5 is a flow diagram illustrating an example technique for cold spraying a feature over a plurality of inserts on a surface of a substrate to form a composite component.

In some examples, a technique may include using inserts to form a wall defining internal channels, threaded holes, through-holes, or other complex geometries embedded in or on the surface of a feature. FIG. 5 is a flow diagram illustrating an example technique for cold spraying feature 66 over a plurality of inserts 64 on surface 63 of substrate 62 to form composite component 60. The technique of FIG. 5 will be described with concurrent reference to system 10 of FIG. 1 and composite component 60 of FIGS. 3A, and 3B. In other examples, other systems may be used to perform the technique of FIG. 5, the technique of FIG. 5 may be used to form other composite components, or both.

The technique illustrated in FIG. 5 includes forming substrate 30 from a first material (90), for example, as discussed above in reference to FIG. 4. The technique illustrated in FIG. 5 also includes positioning at least one insert 64 on surface 63 (92). As discussed above, in some examples, inserts 64 may include a plurality of cooling circuit tubes 70, sacrificial inserts 72 including a sacrificial material, or both. Inserts 64 may be physically coupled, and in some examples fluidly coupled, to define a tortuous path, such as a path of the cooling circuit.

The technique illustrated in FIG. 5 also includes cold spraying to form feature 66, which includes directing the particles of the second material at inserts 64 to substantially encapsulate insert 64 (94). For example, feature 66 may completely encapsulate inserts 64 or partially encapsulate inserts 64. In this way, feature 66 encapsulating inserts 64 that include cooling circuit tubes 70, may include at least a portion of a fluid transfer system.

In some examples, technique illustrated in FIG. 5 may include removing the sacrificial material. For example, as discussed above in reference to FIG. 1, removing the sacrificial material may include at least one of pyrolyzing the sacrificial material or chemically etching the sacrificial material. In this way, feature 66 encapsulating inserts that include sacrificial inserts 72, after removal of sacrificial inserts 72, may include at least a portion of a fluid transfer system.

In some examples, technique illustrated in FIG. 5 may include, after cold spraying feature 66, machining the second material to define feature 66. For example, forming feature 66 may include cold spraying excess second material on to surface 63, then machining away the excess material. Machining away the excess material may enable system 10 to form at least one feature 32 including more complex geometries, with increased precision (e.g., within predetermined tolerances), or both compared to a technique without machining.

The following clauses illustrate example subject matter described herein.

Clause 1. A method comprising forming a substrate from a first material, wherein the substrate defines a surface; and cold spraying a second material comprising a metal or alloy on to at least a portion of the surface of the substrate to form at least one feature, wherein cold spraying comprises accelerating particles of the second material toward the surface without melting the particles.

Clause 2. The method of clause 1, wherein the method further comprises positioning at least one insert on the surface, and wherein cold spraying the at least one feature comprises directing the particles of the second material at the at least one insert to substantially encapsulate the insert.

Clause 3. The method of clause 2, wherein the at least one insert comprises a plurality of cooling circuit tubes.

Clause 4. The method of clause 2, wherein the at least one insert comprises a sacrificial material, and wherein the method further comprises, after cold spraying the at least one feature, removing the at least one insert by removing the sacrificial material.

Clause 5. The method of clause 4, wherein removing the sacrificial material comprises at least one of pyrolyzing the sacrificial material or chemically etching the sacrificial material.

Clause 6. The method of any one of clauses 1 through 5, wherein the first material comprises a higher density, higher melting point temperature metal alloy than the second material.

Clause 7. The method of any one of clauses 1 through 6, wherein the first material comprises a lower density metal alloy than the second material.

Clause 8. The method of any one of clauses 1 through 7, wherein the substrate comprises a sheet metal, and wherein the at least one feature comprises a flange.

Clause 9. The method of any one of clauses 1 through 8, wherein forming the at least one feature comprises, after cold spraying the at least one feature, machining the second material to define the at least one feature.

Clause 10. The method of any one of clauses 1 through 9, wherein the at least one feature comprises at least a portion of a fluid transfer system.

Clause 11. A composite component comprising a substrate comprising a first material, wherein the substrate defines a surface; and at least one feature attached to the surface of the substrate, wherein the at least one feature comprises a second, different material attached to the surface using cold spraying, wherein the second, different material comprises a metal or alloy, and wherein cold spraying comprises accelerating particles of the second material toward the surface without melting the particles.

Clause 12. The composite component of clause 11, further comprising at least one insert on the surface, wherein the at least one feature substantially encapsulates the insert.

Clause 13. The composite component of clause 12, wherein the at least one insert comprises a plurality of cooling circuit tubes.

Clause 14. The composite component of clause 12, wherein the at least one insert comprises a sacrificial material.

Clause 15. The composite component of clause 14, wherein the sacrificial material is configured to be removed from the composite component by at least one of pyrolyzing the sacrificial material or chemically etching the sacrificial material Clause 16. The composite component of any one of clauses 11 through 15, wherein the first material comprises a higher density, higher melting point metal alloy, and wherein the second material comprises a lower density metal alloy.

Clause 17. The composite component of any one of clauses 11 through 16, wherein the first material comprises a lower density metal alloy, and wherein the second material comprises a higher density, higher melting point metal alloy.

Clause 18. The composite component of any one of clauses 11 through 17, wherein the substrate comprises a sheet metal, and wherein the at least one feature comprises a flange.

Clause 19. The composite component of any one of clauses 11 through 18, wherein the at least one feature defines at least a portion of a fluid transfer system.

Clause 20. A component of a gas turbine engine, comprising a casing comprising a first material, wherein the casing defines a surface; and at least one feature attached to the surface of the casing, wherein the at least one feature comprises a second, different material attached to the surface using cold spraying, wherein the second, different material comprises a metal or alloy, wherein cold spraying comprises accelerating particles of the second material toward the surface without melting the particles, and wherein the at least one feature defines at least a portion of a cooling system of the gas turbine engine.

Various examples have been described. These and other examples are within the scope of the following claims.

What is claimed is:

1. A method comprising:

forming a substrate from a first material, wherein the substrate defines a surface; and cold spraying a second material comprising a metal or alloy on to at least a portion of the surface of the substrate to form at least one feature, wherein the first material comprises a higher density, higher melting point temperature metal alloy than the second material, and wherein cold spraying comprises accelerating particles of the second material toward the surface without melting the particles.

2. The method of claim 1, wherein the method further comprises positioning at least one insert on the surface, and wherein cold spraying the at least one feature comprises directing the particles of the second material at the at least one insert to substantially encapsulate the insert.

3. The method of claim 2, wherein the at least one insert comprises a plurality of cooling circuit tubes.

4. The method of claim 2, wherein the at least one insert comprises a sacrificial material, and wherein the method further comprises, after cold spraying the at least one feature, removing the at least one insert by removing the sacrificial material.

5. The method of claim 4, wherein removing the sacrificial material comprises at least one of pyrolyzing the sacrificial material or chemically etching the sacrificial material.

6. The method of claim 1, wherein the substrate comprises a sheet metal, and wherein the at least one feature comprises a flange.

7. The method of claim 1, wherein forming the at least one feature comprises, after cold spraying the at least one feature, machining the second material to define the at least one feature.

8. The method of claim 1, wherein the at least one feature comprises at least a portion of a fluid transfer system.

* * * * *